US012044110B2

(12) United States Patent
Henderson et al.

(10) Patent No.: US 12,044,110 B2
(45) Date of Patent: Jul. 23, 2024

(54) SAFETY SYSTEMS FOR ELECTRIC SUBMERSIBLE PUMPS

(71) Applicant: Schlumberger Technology Corporation, Sugar Land, TX (US)

(72) Inventors: Andrew Henderson, Fife (GB); Calum Crawford, Aberdeenshire (GB); Ivor Maciver, Aberdeenshire (GB); Richard McCann, Aberdeen (GB); Jamie Cochran, Inverurie (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 10 days.

(21) Appl. No.: 17/801,153

(22) PCT Filed: Feb. 19, 2021

(86) PCT No.: PCT/EP2021/054219

§ 371 (c)(1),
(2) Date: Aug. 19, 2022

(87) PCT Pub. No.: WO2021/165501

PCT Pub. Date: Aug. 26, 2021

(65) Prior Publication Data

US 2023/0076519 A1 Mar. 9, 2023

Related U.S. Application Data

(60) Provisional application No. 62/978,660, filed on Feb. 19, 2020.

(51) Int. Cl.

| | |
|---|---|
| ***E21B 43/12*** | (2006.01) |
| ***E21B 34/06*** | (2006.01) |
| ***F04D 13/10*** | (2006.01) |

(52) U.S. Cl.
CPC ..... *E21B 43/128* (2013.01); *E21B 34/06* (2013.01); *F04D 13/10* (2013.01)

(58) Field of Classification Search
CPC .... E21B 43/128; E21B 43/13; E21B 23/0419; E21B 34/06; F04D 13/06; F04D 13/08; F04D 13/10
See application file for complete search history.

(56) References Cited

U.S. PATENT DOCUMENTS 2,749,992 A * 6/1956 Hill ..... F04D 13/10 166/325
10,036,210 B2 7/2018 Maclean et al.
(Continued)

FOREIGN PATENT DOCUMENTS

GB 2359571 A 8/2001
RU 2693118 C1 7/2019
(Continued)

OTHER PUBLICATIONS

International Search Report and Written Opinion dated May 21, 2021, for International Application No. PCT/EP2021/054219.
(Continued)

*Primary Examiner* — Christopher J Sebesta
*Assistant Examiner* — Yanick A Akaragwe
(74) *Attorney, Agent, or Firm* — Jeffrey D. Frantz

(57) ABSTRACT

An electrical submersible pump (ESP) system, comprises a motor rotationally coupled to a pump. The system has at least one of (i) a rotation stop operable to stop transfer of rotation of the pump to the motor when the ESP is switched off and (ii) a flow control valve operable to stop flow through the pump in both flow directions when the ESP is switched off.

15 Claims, 12 Drawing Sheets

(56) References Cited

U.S. PATENT DOCUMENTS

| | | | | |
|---|---|---|---|---|
| 2016/0123123 | A1 | 5/2016 | Maclean et al. | |
| 2020/0032599 | A1* | 1/2020 | Biddick | E21B 23/01 |
| 2020/0063541 | A1* | 2/2020 | Davis | F04D 29/043 |
| 2021/0095674 | A1* | 4/2021 | Lu | F04D 13/10 |

FOREIGN PATENT DOCUMENTS

| | | | |
|---|---|---|---|
| WO | 2013/119194 | A1 | 8/2013 |
| WO | 2016/036342 | A1 | 3/2016 |
| WO | 2018/236516 | A1 | 12/2018 |
| WO | 2021/062241 | A1 | 4/2021 |

OTHER PUBLICATIONS

Substantive Exam issued in Saudi Arabia Patent Application No. 522433373 dated Sep. 16, 2023, 12 pages with English translation.
Exam Report issued in United Kingdom Patent Application No. GB2210564.7 dated Jul. 19, 2023, 5 pages.

* cited by examiner

SAFETY SYSTEMS FOR ELECTRIC SUBMERSIBLE PUMPS

CROSS-REFERENCE TO RELATED APPLICATIONS

This application is a national stage entry under 35 U.S.C. 371 of International Application No. PCT/EP2021/054219, filed Feb. 19, 2021, which claims priority to U.S. Provisional Patent Application No. 62/978,660, filed Feb. 19, 2020.

FIELD

This disclosure relates to the field of rotary electric submersible pumps (ESPs). More specifically, the disclosure relates to apparatus for preventing flow-induced rotation of such ESPs when powered off to avoid inadvertent generation of electric voltage and consequent hazard to personnel and equipment associated with such pumps.

BACKGROUND

Rotary ESPs are used to lift liquid from subsurface wells to surface. Lift may be used for both adding energy to fluid having insufficient subsurface pressure to rise to surface naturally and to relieve hydrostatic fluid pressure of higher density fluid (e.g., water) in a well so that lower density fluid (e.g., gas) can rise to surface.

Rotary ESPs comprise an electric motor, a protector/drive shaft and a rotary pump such as a single or multi-stage centrifugal pump arranged in an axially elongated housing. Some ESPs use single or multi-phase induction motors having stator field windings to induce a magnetic field for the motor. The field windings are energized with electric current to induce the magnetic field whereby an armature (rotor) is induced to rotate in the magnetic field. When such motors are deenergized, there is essentially no static magnetic field in the motor. Rotating the armature therefore has no effect.

More recently, permanent magnet motors (PMMs) have been developed for use with ESPs. PMMs make possible designing ESPs to fit in smaller diameter housings than are possible with induction motors, and ESPs using such motors may be deployed within well production tubing. One maker of such PMM electric submersible pumps is ZiLift Ltd., Units 17-19 Greenrole Trading Estate, Howe Moss Drive, Dyce, Aberdeen, AB21 OGL, Scotland, the assignee of the present disclosure.

It is known in the art that the pump section, and thereby the motor in ESPs, may be caused to rotate by reason of fluid flow in a well not induced by the pump. Fluid flow may be induced, for example, by back flow of fluid after pump shutdown, by a formation unexpectedly flowing into the well (a "kick") and by unexpected fluid loss into a rock formation adjacent the well. Rotation of the motor as a result of induced flow may cause the motor, particularly a PMM, to generate electrical voltage, which may then be impressed on the power cable that extends from the ESP to surface. Such impressed voltage is a hazard to equipment connected to the power cable and to persons working on the ESP. Fatalities are known to have occurred as a result of such impressed voltages.

There is a need for safety apparatus for use with ESPs to reduce the possibility of inadvertent generation of electrical voltages by the electric motor.

SUMMARY

One aspect of the present disclosure is an electrical submersible pump (ESP) system. The system comprises a motor rotationally coupled to a pump. The system has at least one of (i) a rotation stop operable to stop transfer of rotation of the pump to the motor when the ESP is switched off and (ii) a flow control valve operable to stop flow through the pump in both flow directions when the ESP is switched off.

The rotation stop may comprise a clutch disposed between the pump and the motor.

The rotation stop may comprise a rotation lock.

The rotation lock may comprise a sprag rotationally coupled between a drive shaft rotated by the motor and an ESP housing.

The rotation lock may comprise a solenoid actuated lock pin movable between an unlocked position and a locked position, wherein in the locked position the lock pin extends through a lock disk rotatably coupled to a shaft rotationally coupled to the pump and having at least one lock opening therethrough for receiving the lock pin.

The ESP system may further comprise a pump discharge valve fluidly disposed between an outlet of the pump and a well tube in which the ESP is disposed during operation of the ESP.

The pump discharge valve may comprise at least one ball type check valve.

The pump discharge valve may comprise a shuttle valve.

The pump discharge valve may comprise a rotary disk valve.

The ESP system may further comprise a pump inlet control valve fluidly disposed between an inlet of the pump and an inlet to the ESP below the pump inlet.

The pump inlet control valve may comprise a ball type check valve operable to block flow through the pump in a direction from a pump outlet to the pump inlet.

The pump inlet control valve may comprise a relief valve fluidly connecting an inlet to the pump to an annular space between the ESP and a well tube in which the ESP is disposed during operation, the relief valve operable to open at a predetermined pressure.

The pump inlet control valve may comprise a check valve operable to block flow through the pump in a direction from a pump outlet to the pump inlet and a check valve operable to block flow in a direction from an annular space between the ESP and a well tube in which the ESP is disposed during operation to below the check valve.

The flow control valve operable to stop flow through the pump in both flow directions may comprise a rotary disk valve.

The rotary disk valve may comprise at least one magnet disposed on a drive shaft, the drive shaft passing through a valve disk having at least one magnet thereon, the at least one magnet on the drive shaft and on the valve disk arranged to apply a torque to the valve disk corresponding to rotation of the drive shaft.

Other aspects and possible advantages will be apparent from the description and claims that follow.

DETAILED DESCRIPTION

Figure 1:
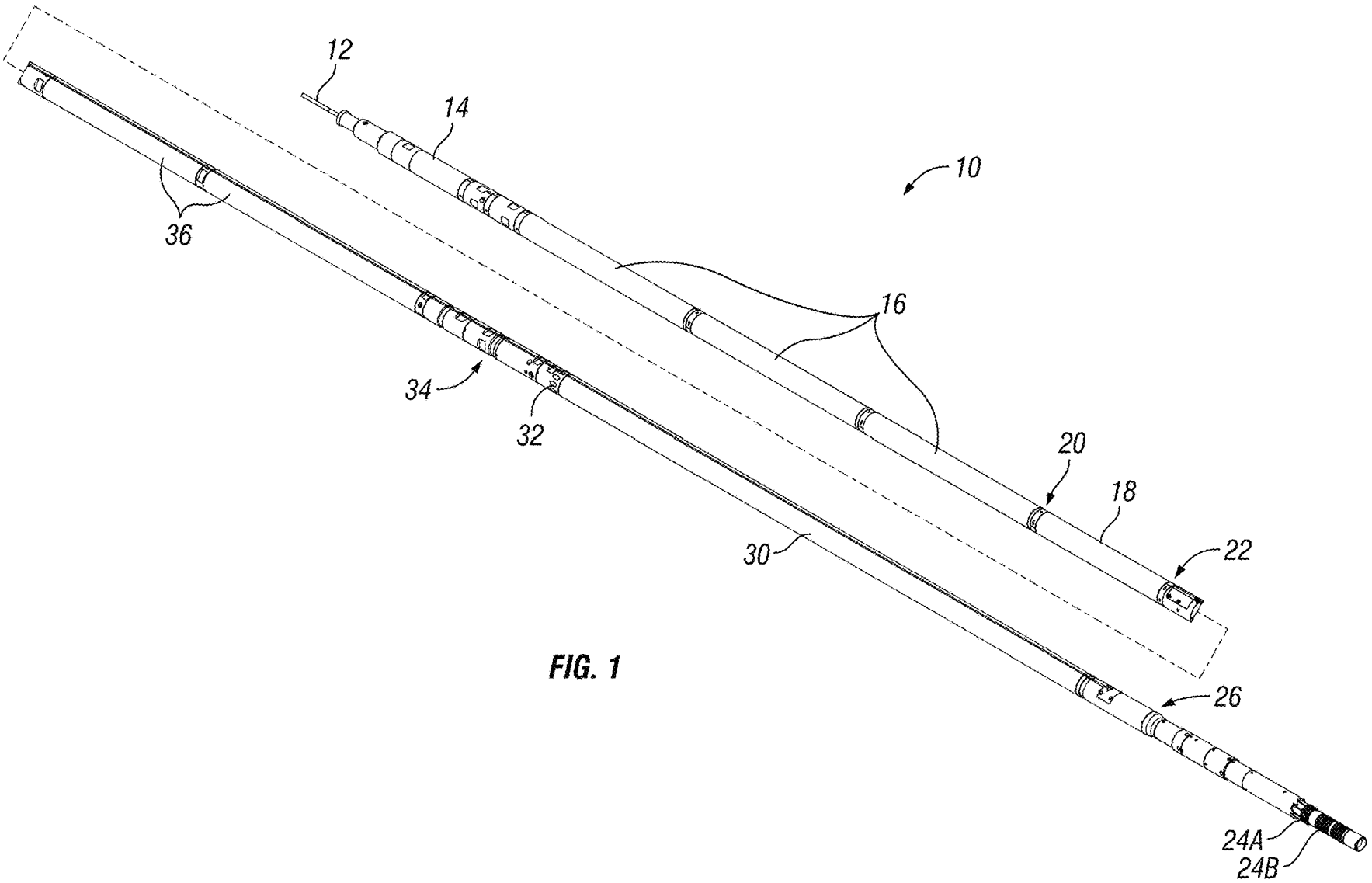
FIG. 1 shows an ESP system comprising one or more electrical safety features according to the present disclosure.

FIG. 1 shows an electric submersible pump (ESP) 10 which may comprise one or more safety features according to the present disclosure. In general terms, the one or more safety features are operable to either (i) prevent rotation of a pump by reason of flow in a wellbore (and thus through the pump) not resulting from powered operation of the ESP 10, that is, when the ESP is switched off, or (ii) stop flow through the pump in both directions so as to prevent flow induced pump rotation. Preventing pump rotation will prevent consequent motor rotation and resulting electric voltage generation. The ESP shown in FIG. 1 may be deployed at the end of an electrical cable, such as tubing encapsulated cable. See, for example, U.S. Pat. No. 10,036,210 issued to Maclean et al. and assigned to the assignee of the present disclosure. It should be clearly understood that an ESP having safety features according to the present disclosure may be conveyed into a well by any other means known in the art, including, without limitation by a production tubing, coiled tubing, rod string or other known conveyance. Further, reference to sealing elements such as packers is provided to illustrate the principles of various safety features according to the present disclosure and therefore should not be construed as limitations on the scope of this disclosure. It is also to be clearly understood that an ESP having safety features according to the present disclosure may have any type of electric motor, notwithstanding that such safety features may be particularly important with ESPs having permanent magnet motors.

The ESP 10 may be deployed by electrical cable 12 as explained above. The electrical cable 12 may be coupled to the ESP 10 using a cable connector 14 of types known in the art for connection of electrical cables, in particular cables intended to carry the weight of tool attached to the end of the cable. The cable connector 14 may be coupled to the ESP system housing. The end of the housing to which the cable is connected may contain one or more electric motors 16. The one or more electric motor(s) 16 may be permanent magnet motors. At 20, a rotation stop may be disposed in the ESP 10 axially between the electric motor(s) 16 and one or more protector/seal section(s) 36. The axial position of the rotation stop 20 is a matter of convenience in any described example according to the present disclosure, and it will be appreciated that in other examples the axial position for the rotation stop 20 may be elsewhere in the ESP. For purposes of the present disclosure, it is only necessary for the rotation stop 20 to prevent rotation of the electric motor(s) 16 in the ESP 10 as a result of flow-caused rotation of a pump, explained further below.

As will be appreciated by those skilled in the art, the one or more protector/seal section(s) 36 enclose(s) a drive shaft (40 in FIGS. 2A and 2B) that couples rotary output of the electric motor(s) 16 to the pump, shown at 30, the pump 30 being disposed axially further along the ESP 10 from the electric motor(s) 16 than the protector/seal sections 36. The ESP 10 has the electric motor(s) 16 disposed axially closer to the cable connector 14 than the pump 30, that is the electric motor(s) 16 are above the pump 30 with reference to the surface direction of a well in which the ESP 10 is deployed. It should be understood that other known configurations of ESP, wherein the pump is above the motor are within the scope of the present disclosure. The pump 30 may comprise one or more stages of rotary pump, for example, centrifugal pump(s) or positive displacement pump(s) such as progressive cavity pumps. The type of pump and the number of pump stages are not limitations on the scope of the present disclosure.

A monitoring system 18 may be disposed in the ESP 10 below the electric motor(s) 16 and above the one or more seal section/protector(s) 36, and may comprise one or more sensors and controls (not shown separately) for measuring operating parameters and providing control over the ESP 10. The rotation stop 20 may comprises a rotation lock such as a solenoid operated rotation lock 22, to be explained further below. The solenoid operated rotation lock 22 may be disposed axially below the monitoring system 18 and above the pump 30. The solenoid operated rotation lock 22 will be explained in more detail below, however it will be appreciated that such rotation lock may be disposed at any axial position along the ESP 10 provided that actuation of a solenoid therein deploys a locking pin or similar device to prevent rotation of the electric motor(s) 16. When the electric motor(s) are rotationally connected at all times to all rotary components from the motor(s) 16 to the pump 30, the solenoid operated rotation lock 22 may act to stop rotation of any rotary component in the ESP 10 and will as a result stop rotation of the electric motor(s) 16 when the ESP 10 is switched off. As used in this disclosure, the term "rotation lock" means any device, whether active, such as the solenoid operated rotation lock 22, or passive devices, examples of which will be described further below. "Rotation stop" as used herein means any device which acts to prevent transmitting induced rotation in the pump 30 to the electric motor(s) 16 irrespective of whether induced pump rotation is stopped. A non-limiting example of a rotation stop is a clutch such as a magnetic clutch or centrifugal clutch, which may rotationally disconnect the electric motor(s) 16 from the pump 30 when the ESP 10 is switched off. For purposes of defining the scope of the present disclosure, a "rotation lock" is within the scope of "rotation stop" because a rotation lock performs the function of stopping transmission of induced pump rotation to the electric motor(s), albeit by preventing all rotation within the ESP.

A pump discharge valve 34 may be disposed between the protector/seal section(s) 36 and the pump 30, wherein fluid flow from the pump outlet (not shown) is directed into an annular space between the ESP 10 and a well production tube in which the ESP is disposed, for example, production tubing (not shown). Various examples of the pump discharge valve 34 will be explained in more detail below. The pump fluid discharge from the pump discharge valve 34 is shown at 32.

At 26, a pump intake control valve may be provided to control flow into, through or bypass around an inlet (not shown separately) of the pump 30. The functions of various examples of pump intake control valve 26 will be further explained below, however, in general terms, the pump intake control valve 26 may perform either or both the functions of preventing backflow through the pump 30 when the ESP is switched off, and bypassing flow around the pump 30 into the annular space (not shown) when flow from below the pump 30 exceeds the flow capacity of the pump 30 to move fluid. The latter condition may occur, for example, when hydrostatic pressure on a fluidly connected subsurface formation is relieved such the flow into the well from such formation exceeds the flow capacity of the pump 30. Such condition is known as a "kick" and may present a safety hazard, more specifically if such kick is able to pass through the pump 30 and induce overspeed pump rotation.

The ESP 10 may have proximate its lower longitudinal end a packer stinger 24B and latch 24A to sealingly engage and lock into an annular seal element (not shown), e.g., a "packer", which provides that flow originating below the ESP 10 into the well is constrained to move within the well tube in which the ESP is disposed, e.g., production tubing (not shown).

Figure 2B:
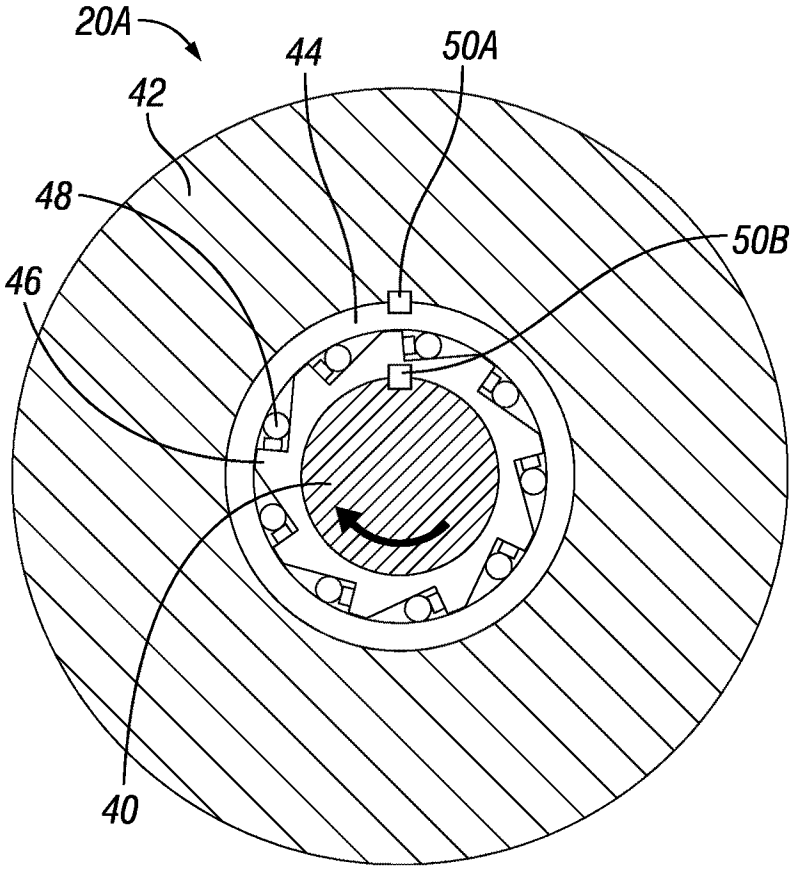
FIGS. 2A and 2B show a rotation lock in the form of a one way clutch (sprag).
Figure 2A:
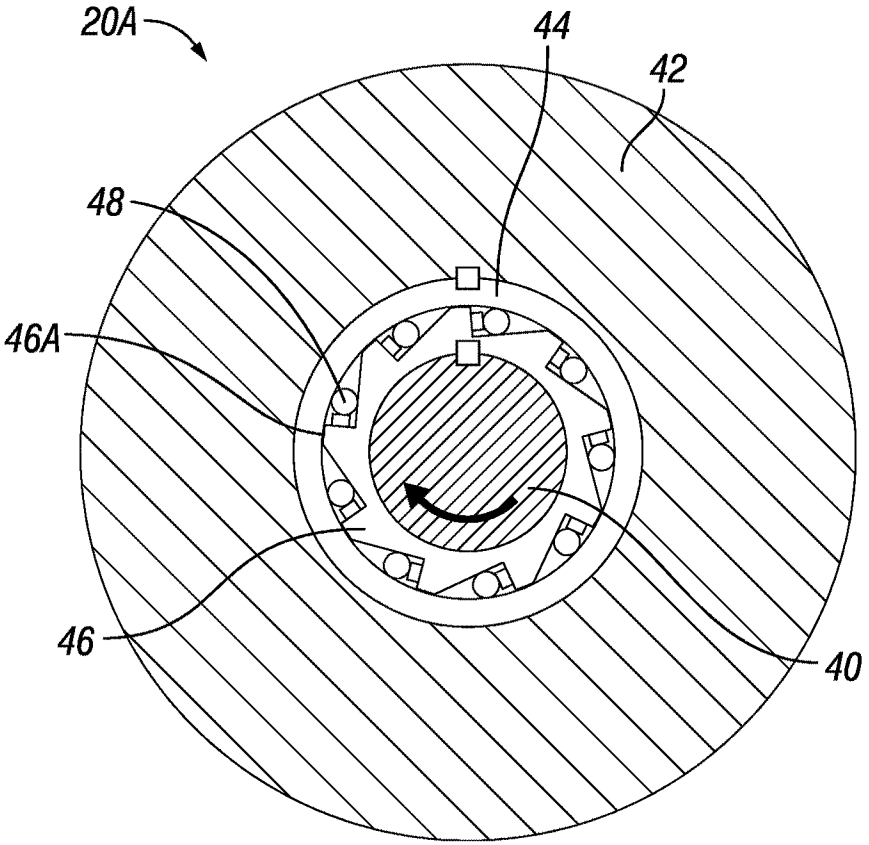

The rotation stop at 20 in FIG. 1 may be better understood with reference to FIGS. 2A and 2B. The rotation stop 20 may be a rotation lock, and in particular a passive rotation lock, for example, a sprag. The sprag may comprise a sprag roller frame 46 having sprag roller retainers 46A disposed at circumferentially spaced locations around the circumference of the sprag roller frame 46. The sprag roller frame 46 may be rotationally coupled to the drive shaft 40 (described with reference to FIG. 1), for example, using a key 50B. A sprag outer race 44 may be rotationally coupled to the ESP housing at 42, using a key at 50A, for example, within the longitudinal part thereof as shown in FIG. 1. Sprag rollers 48 may be disposed as shown between the sprag roller retainers 46A. The sprag components shown will enable free rotation of the drive shaft 40 within the housing 42 in the direction indicated by the arrow, and will stop rotation in the opposed direction. The direction indicated by the arrow corresponds to the ordinary direction of rotation of the pump and electric motor(s) (see FIG. 1) during powered operation of the ESP (10 in FIG. 1) By locking the drive shaft 40 against such reverse rotation, fluid flow downward in a well cannot rotate the pump (30 in FIG. 1) to cause corresponding rotation of the electric motor(s) (16 in FIG. 1) and resulting generation of electrical voltage by the electric motor(s) (16 in FIG. 1).

Figure 3A:
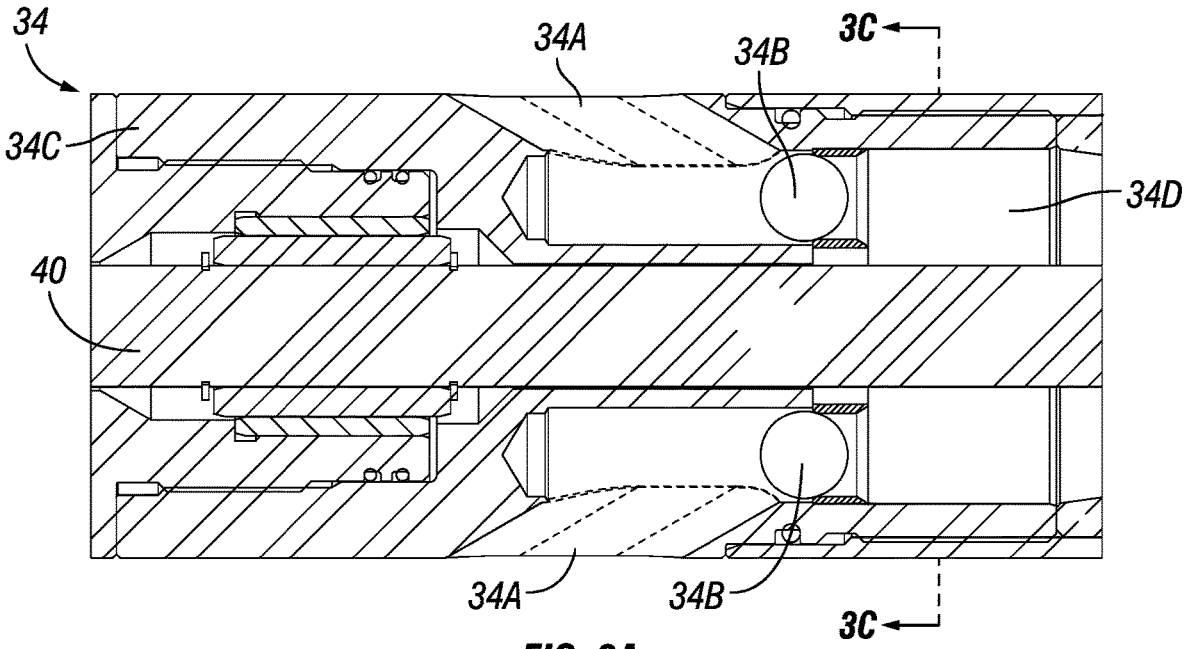
FIGS. 3A, 3B and 3C show a pump discharge valve.
Figure 3B:
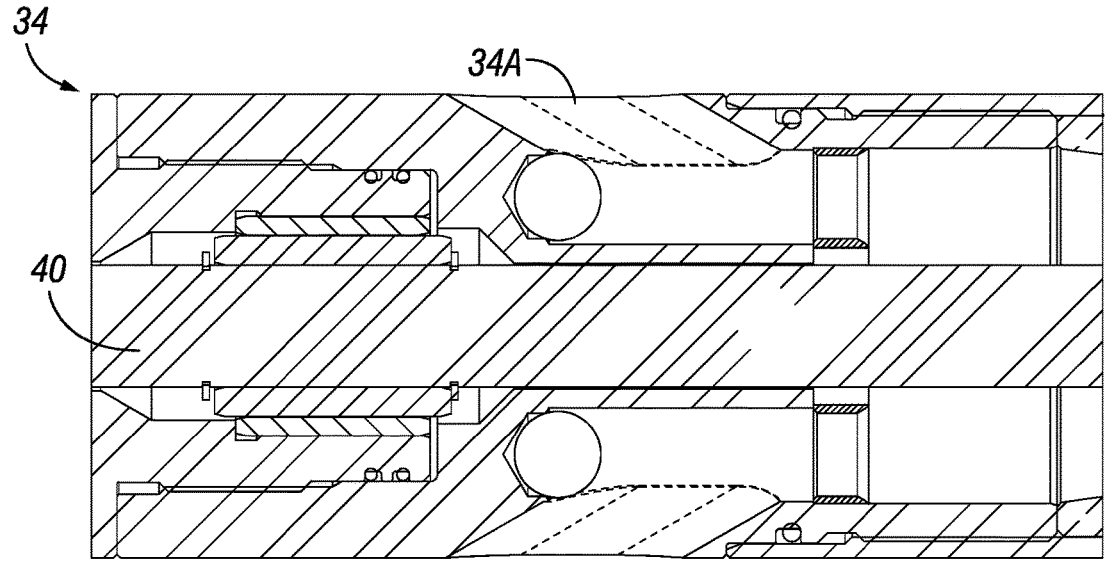
Figure 3C:
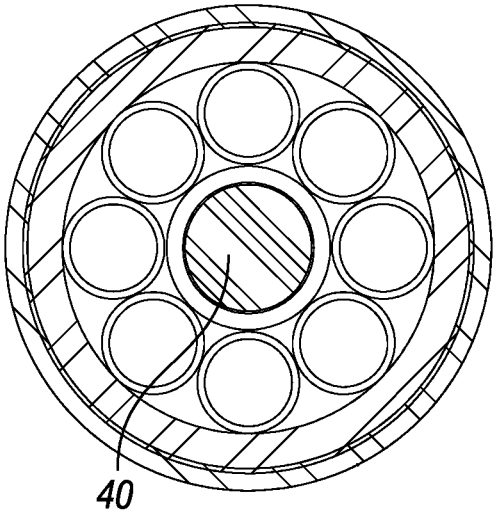

FIGS. 3A, 3B and 3C show, respectively, side views and a cross-sectional view of the pump discharge valve 34. A valve housing 34C may have suitable longitudinal end connections for coupling within the ESP (10 in FIG. 1) as shown in FIG. 1. The valve housing 34C may comprise one or more discharge ports 34A making a fluid connection between the discharge ports 34A and a housing inlet 34D. The foregoing parts of the housing 34C may be disposed circumferentially around the center of the housing 34C wherein the driveshaft 40 may pass freely therethrough. A valve ball 34B may be disposed as shown in FIGS. 3A and 3B such that the respective flow port 34A is open to flow when the pump (30 in FIG. 1) is operated and closed when the pump is stopped. By such operation of the pump discharge valve 34, reverse flow through the pump (30 in FIG. 1) is impeded, thereby preventing flow-caused rotation of the pump (30 in FIG. 1) and correspondingly the motor(s) (16 in FIG. 1). FIGS. 3A and 3B show the pump discharge valve 34, respectively, in the closed position and the open position.

Figure 4A:
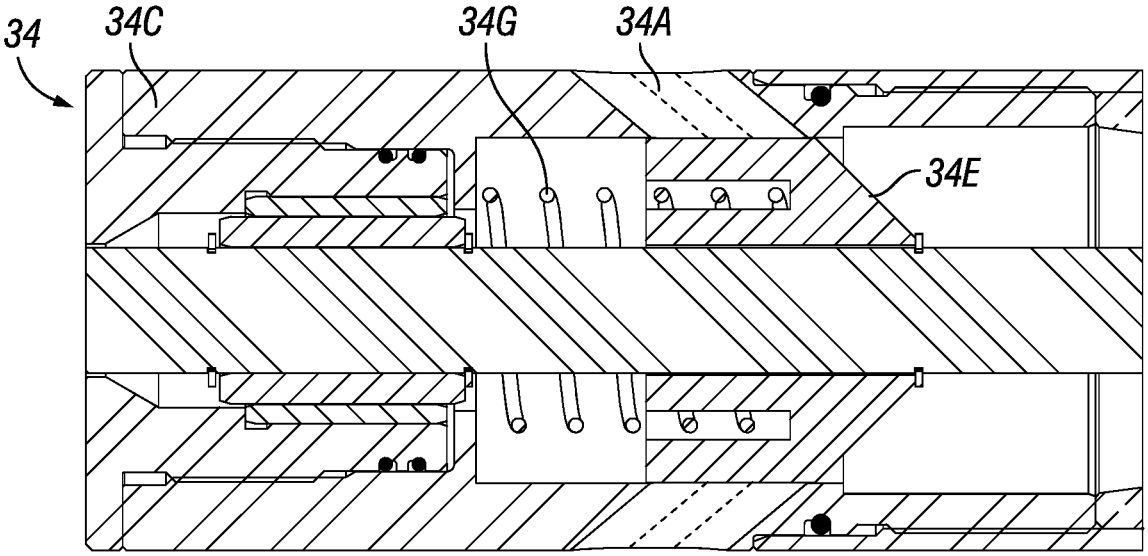
FIGS. 4A and 4B show an alternative pump discharge valve.
Figure 4B:
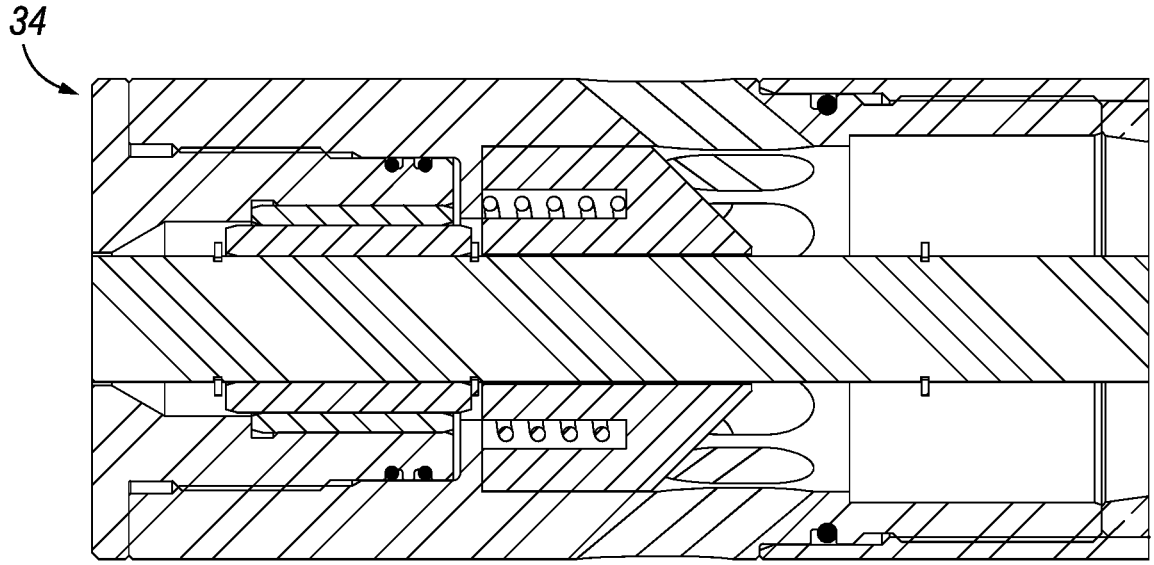

FIGS. 4A and 4B show an alternative pump discharge valve 34, which is a shuttle valve. A valve shuttle 34E may be urged in the direction shown in FIG. 4A by a biasing device 34G such as a spring such that the shuttle 34E blocks the discharge ports 34A in the valve housing 34C when the pump (30 in FIG. 1) is stopped. When the pump (30 in FIG. 1) is started, flow therefrom urges the shuttle 34E against the spring 34G, thereby moving the shuttle 34E to open the flow ports 34A. By such operation of the pump discharge valve 34, reverse flow through the pump (30 in FIG. 1) is impeded, thereby preventing flow-caused rotation of the pump (30 in FIG. 1) and correspondingly the motor(s) (16 in FIG. 1). FIGS. 4A and 4B show the pump discharge valve 34, respectively, in the closed position and the open position.

An ESP having a pump discharge valve may have the advantage of a mechanism to reduce or eliminate settling of solids in the pump during periods in which the ESP is switched off. As will be appreciated by those skilled in the art, on shut down, solids such as sand may settle from the fluid column above the pump within the well, e.g., in the production tubing. By limiting flow back into the pump, the pump discharge valve may limit the introduction of solids into the pump through the pump discharge as well as prevent flow induced pump rotation.

Figure 5A:
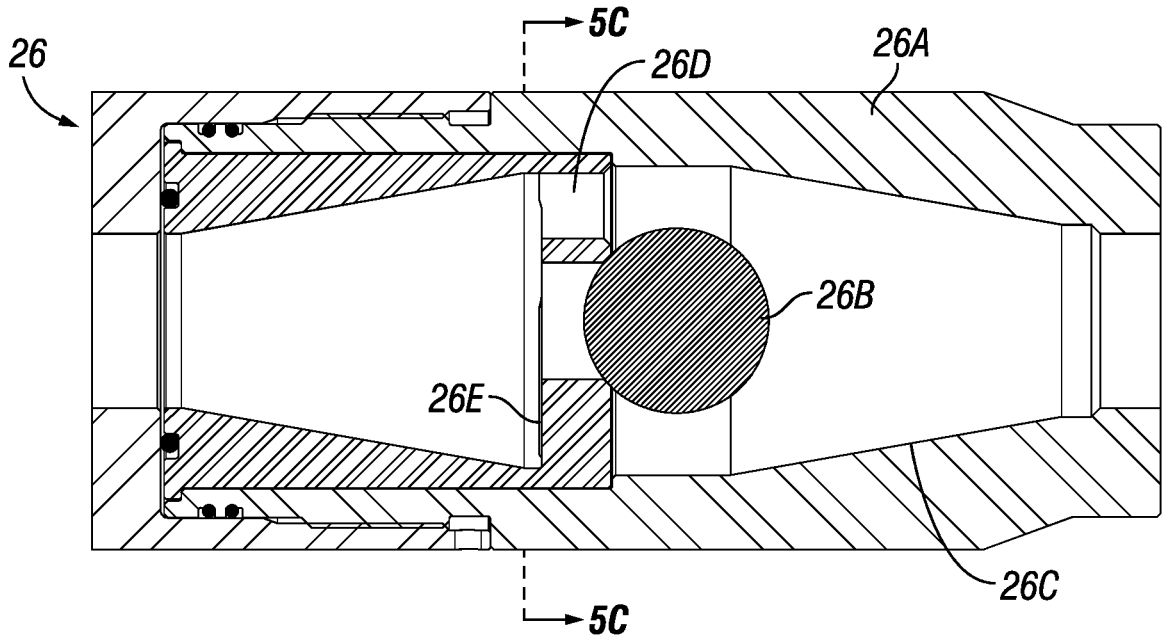
FIGS. 5A, 5B and 5C show an intake control valve.
Figure 5B:
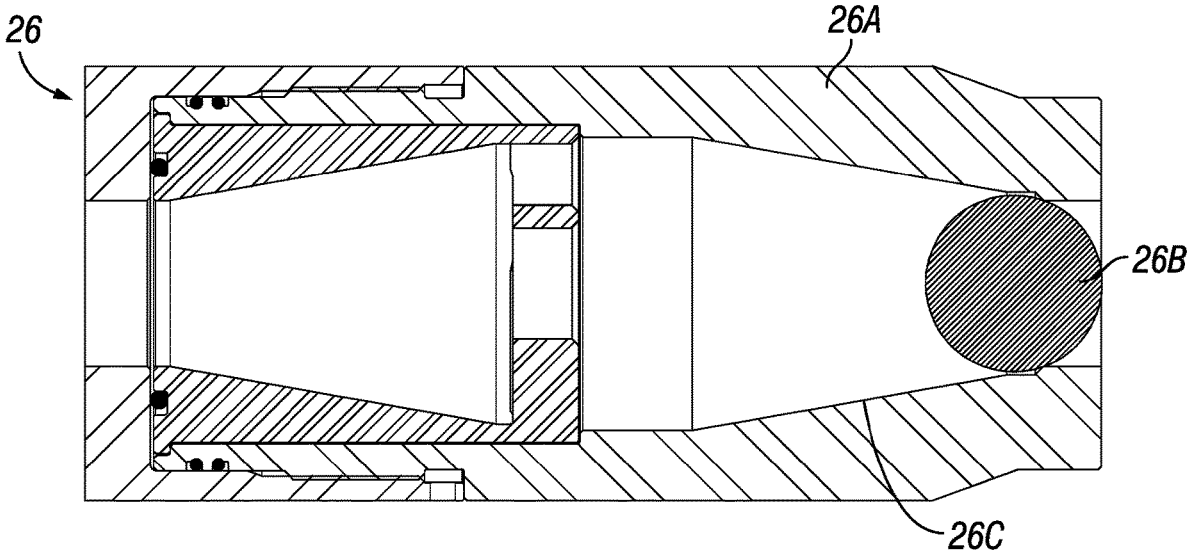
Figure 5C:
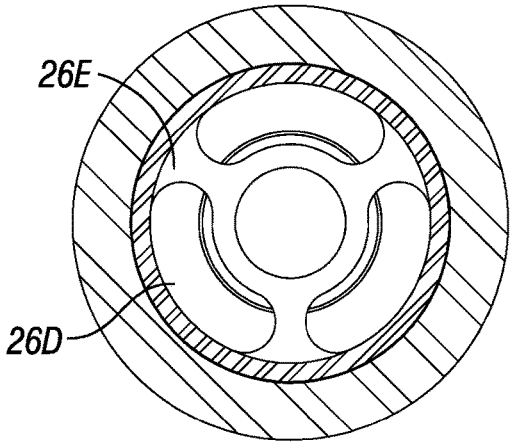

FIGS. 5A, 5B and 5C, show, respectively, side views and a cross-sectional view of the pump intake control valve 26. The pump intake control valve may comprise a ball/seat check valve, comprising a check ball 26B disposed in a valve housing 26A such that operation of the pump (30 in FIG. 1) causes fluid flow displacement of the check ball 26B from a ball seat so as to open the valve 26 to flow. When the pump (30 in FIG. 1) is stopped, any flow through the pump (30 in FIG. 1) will be stopped by movement of the check ball 26B against the ball seat 26C. The foregoing may prevent backflow through the pump (30 in FIG. 1) and corresponding induced rotation and consequent generation of electrical voltage by the motor(s) (16 in FIG. 1). FIGS. 5A and 5B show, respectively, the pump intake control valve 26 in the open position and closed position. A ball retainer 26E having one or more flow ports 26D may be observed in cross-section in FIG. 5C to illustrate how the check ball 26B may be retained while enabling full flow through the pump intake control valve 26.

Figure 6A:
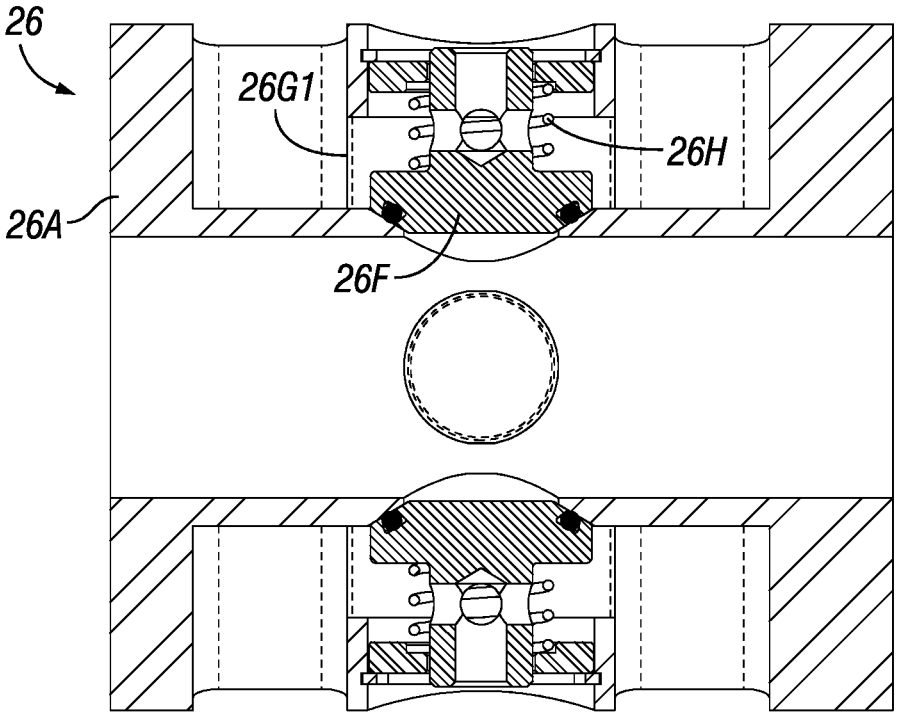
FIGS. 6A and 6B show an alternative intake control valve.
Figure 6B:
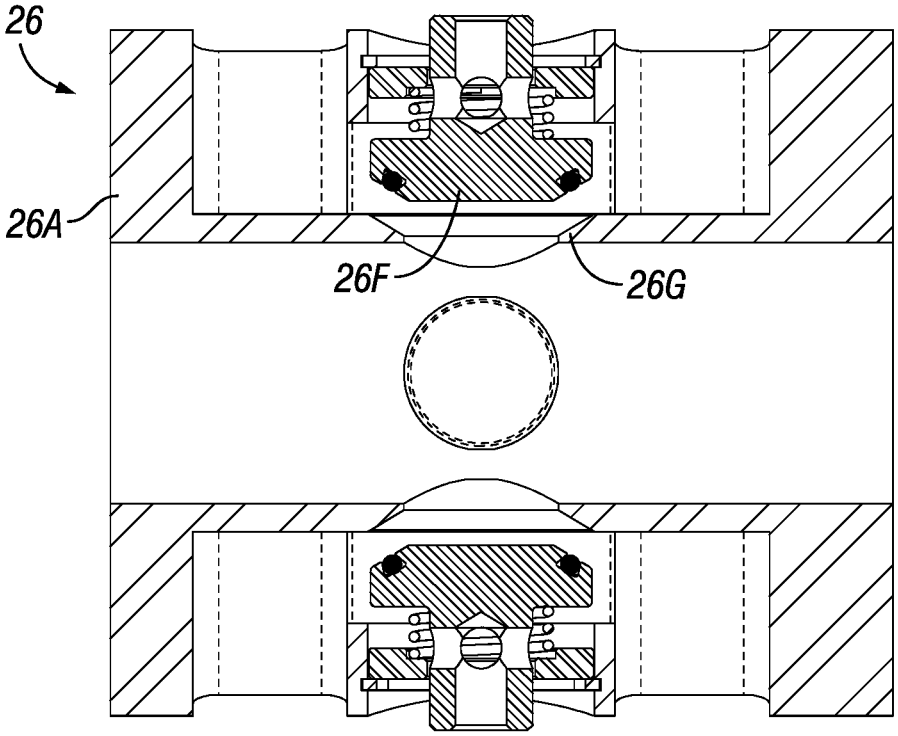

FIGS. 6A and 6B show an alternative pump intake control valve 26, in the closed and open positions, respectively. The intake control valve 26 acts as a flow bypass operable to divert excess flow from the well below the pump (30 in FIG. 1) to the pump discharge (32 in FIG. 1). The pump intake control valve housing 26A may comprise one or more bypass ports 26G1 formed through the sidewall of the housing 26A to enable flow of fluid from an interior of the housing 26A to the exterior when one or more corresponding poppet valves 26F are urged off corresponding valve seats 26G against pressure of a biasing device 26H such as a spring. In operation, movement of fluid into the valve housing 26A so as to create pressure above the opening pressure of the one or more poppet valves 26F causes flow to move around the pump (30 in FIG. 1) into the annular space between the pump (30 in FIG. 1) and the production tubing (not shown).

Figure 7A:
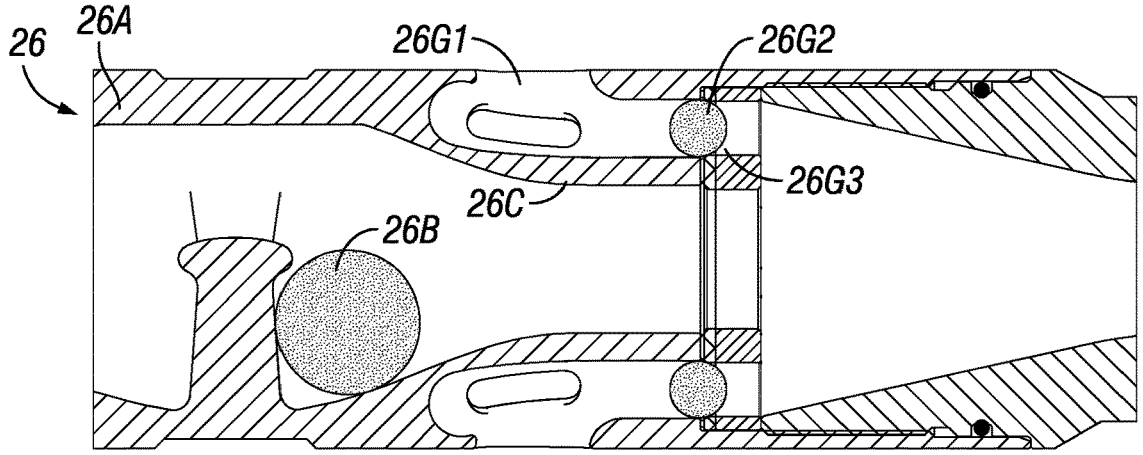
FIGS. 7A, 7B and 7C show an alternative intake control valve.
Figure 7B:
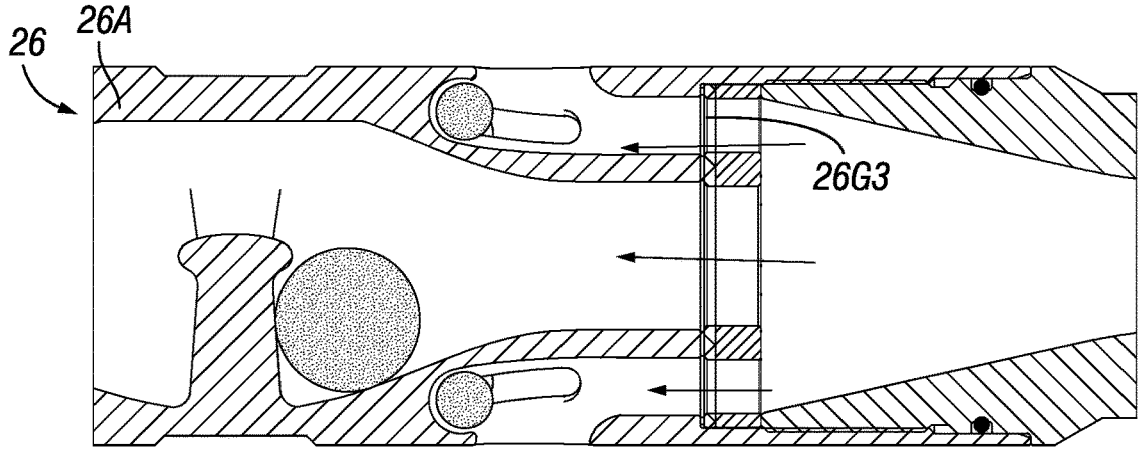
Figure 7C:
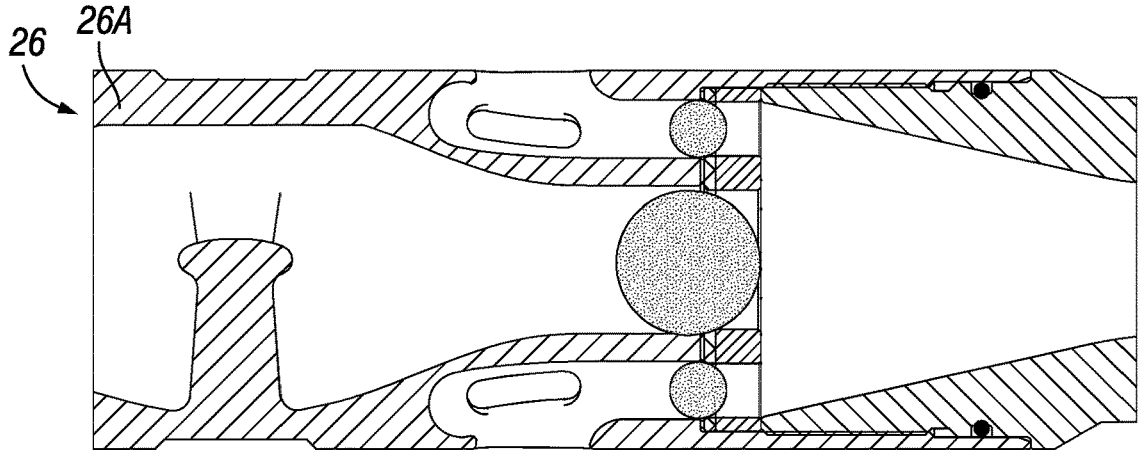

FIGS. 7A through 7C show another alternative pump intake control valve 26. The pump intake control valve may comprise a pump intake check ball 26B that may be lifted from a ball seat 26C when flow (see arrows in FIG. 7B) moves from below the pump (30 in FIG. 1) toward surface. Such flow may take place when the pump (30 in FIG. 1) is operating or in the circumstances when flow from below the pump exceeds the flow rate capacity of the pump (e.g., in a kick) or when the pump is lowered into a well. During ordinary pump operation, flow moves into the pump inlet through the pump intake control valve 26, and is discharged through the pump discharge (32 in FIG. 1).

As stated earlier, such discharge is into the annular space between the pump (30 in FIG. 1) and the production tubing. The pump intake control valve housing 26A comprises one or more bypass flow ports 26G1 that connect the annular space to the space below the pump inlet and below the check ball seat 26C. As a result, during ordinary pump operation, higher pressure exists in the annular space than below the check ball seat 26C. Thus, a corresponding bypass check ball 26G2 in each bypass flow port 26G1 will be urged against a corresponding bypass ball seat 26G3 to close the respective bypass flow port 26G1. Thus, fluid may enter the pump inlet, but pump discharge is prevented from flowing back into the pump inlet. In the event fluid flowing from below the pump (30 in FIG. 1) exceeds the flow rate capacity of the pump, pressure in the annular space below the bypass ball seat 26G3 may exceed pressure in the annular space. In such event, and as may be observed in FIG. 7B, the check ball 26B may be off its seat 26C and the bypass check ball(s) 26G2 may be off the respective seat(s) 26G3, enabling both through-pump flow and bypass flow. Such flow is indicated by flow arrows in FIG. 7B. Such flow may result from a fluid entry into the well (a kick) or by fluid displacement as the pump (30 in FIG. 1) is lowered into the well through the production tubing.

Figure 8A:
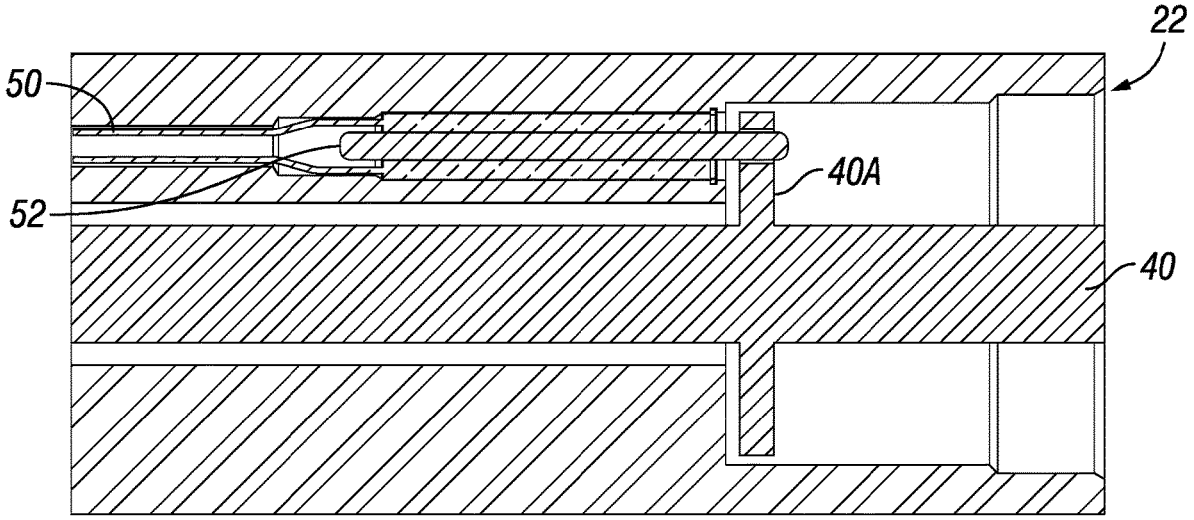
FIGS. 8A, 8B and 8C show a solenoid actuated rotation lock.
Figure 8B:
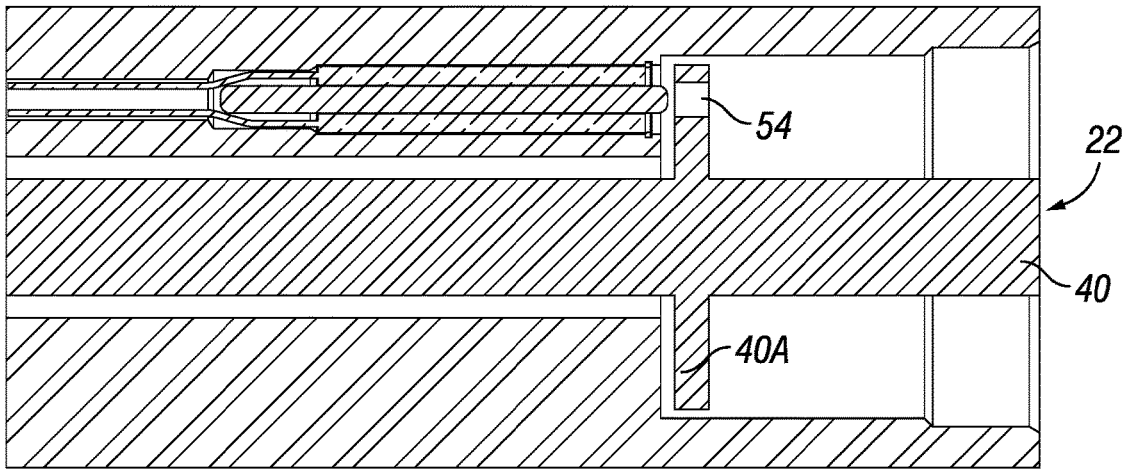
Figure 8C:
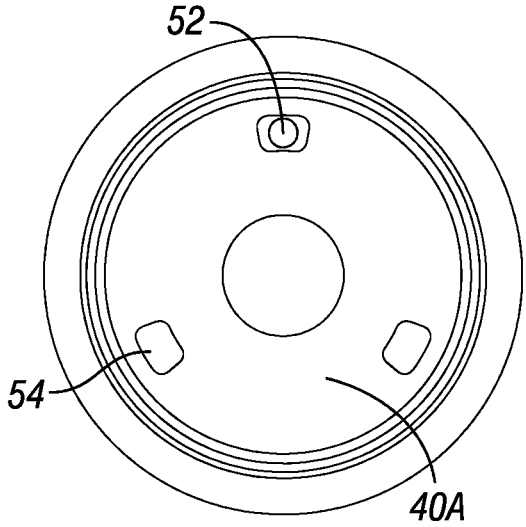
Figure 9A:
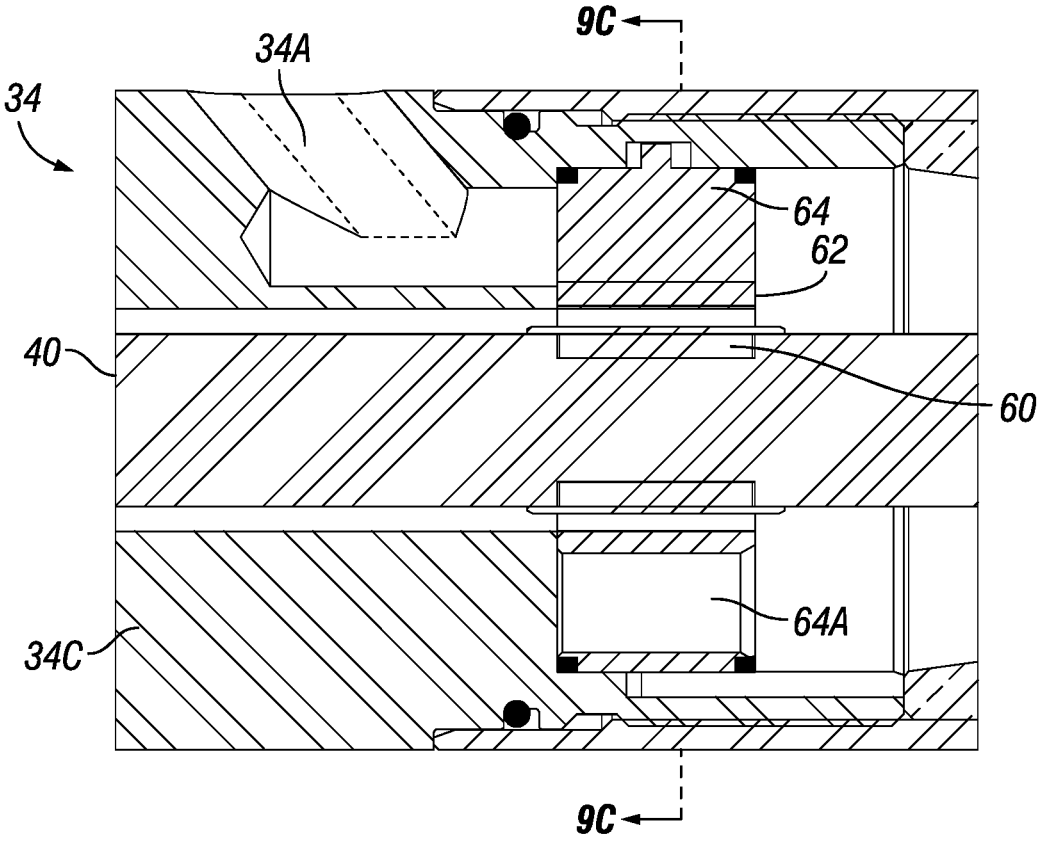
FIGS. 9A through 9D show a rotation actuated pump discharge valve.
Figure 9B:
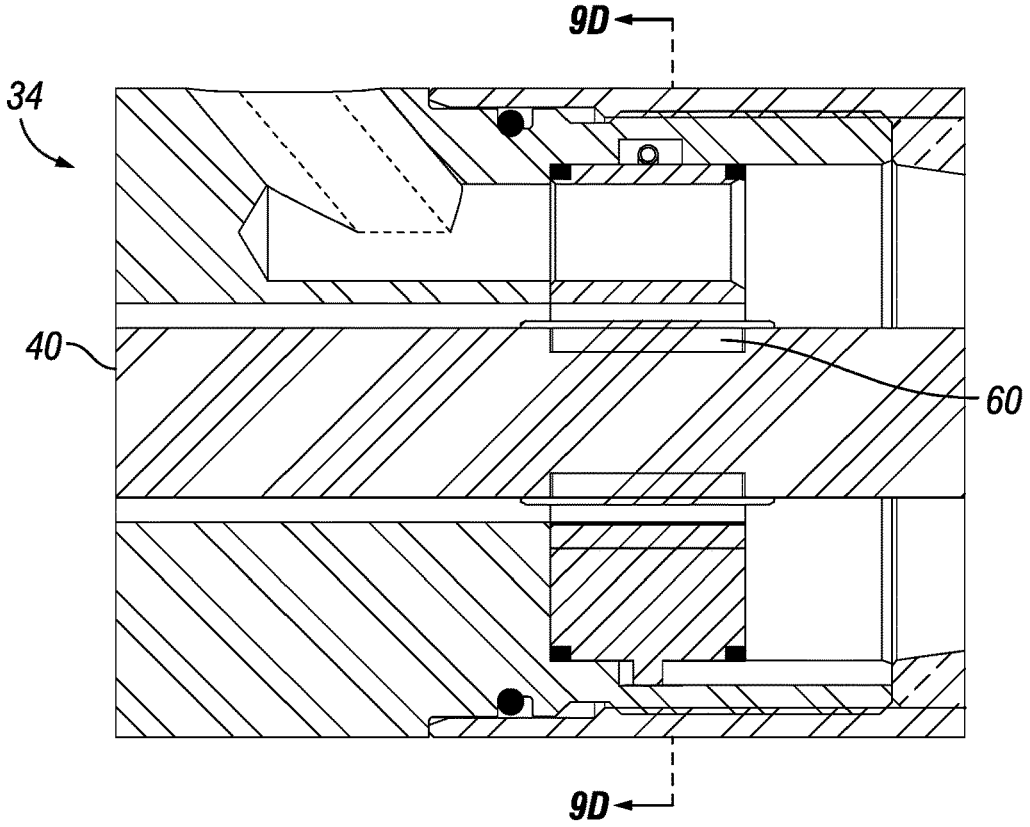
Figure 9C:
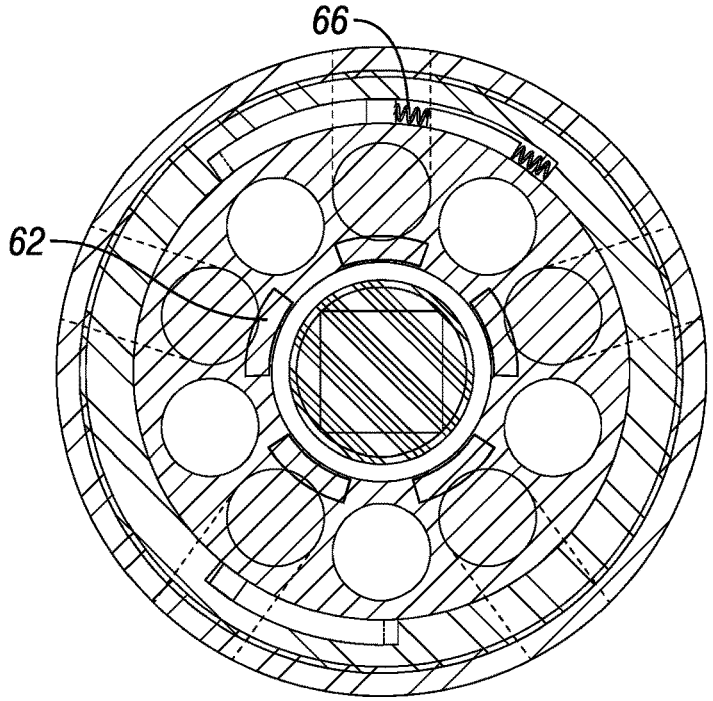
Figure 9D:
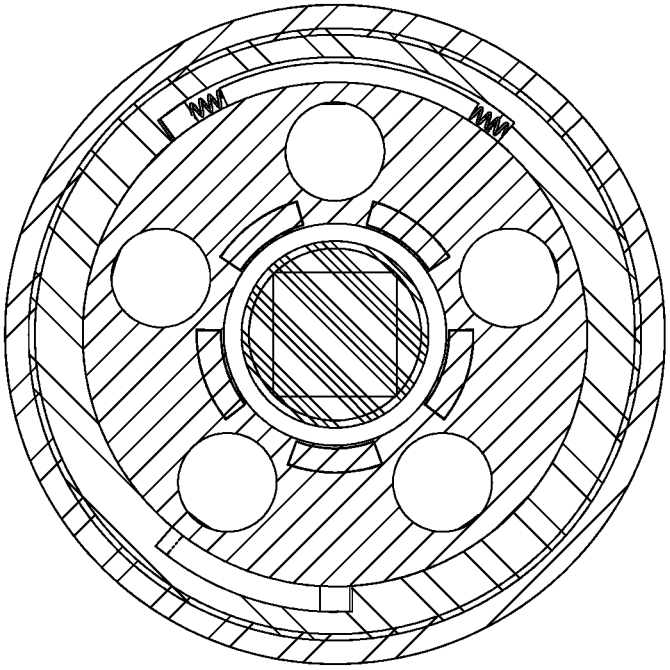

FIGS. 8A, 8B and 8C show various views of the solenoid actuated rotation lock 22 described with reference to FIG. 1. The solenoid actuated rotation lock 22 may be disposed in the ESP (10 in FIG. 1) substantially as shown in FIG. 1, however the particular location of the solenoid actuated rotation lock 22 is not a limitation on the scope of the present disclosure. A lock disk 40A having one or more lock pin openings 54 may be formed with, attached to or otherwise rotationally coupled to the drive shaft 40, or any other ESP component rotationally coupled to the drive shaft 40. A solenoid 50 may be electrically energized when desired to operate the ESP (10 in FIG. 1). In such event, energizing the solenoid 50 may magnetically lift a lock pin 52 so that the lock pin 52 is lifted out of one of the lock pin openings 54. FIG. 8A shows the lock pin 52 disposed through one of the lock pin openings 54 so that the drive shaft 40 (or any other rotatable component in the ESP) is rotationally locked to the housing (any of the housing components in FIG. 1). FIG. 8B shows the lock pin 52 lifted out of the lock pin opening 54 so that the drive shaft 40 is free to rotate. While the described example contemplates energizing the solenoid 50 to lift and unlock the lock pin 52, examples wherein deenergizing the solenoid to release the lock pin to be moved by force from a biasing device (e.g., a spring) to release the lock disk may be implemented with equal effect. FIG. 8C shows a cross sectional view of the solenoid actuated rotation lock 22 to illustrate the relative lateral arrangement thereof. A possible advantage of the solenoid actuated rotation lock 22 explained with reference to FIGS. 8A, 8B and 8C is that rotation is prevented in both directions, whereby flow through the pump (30 in FIG. 1) in the forward direction such as from a kick is stopped with equal effect to flow from above such as by backflow. Therefore, inadvertent motor rotation with the pump stopped is avoided irrespective of flow direction.

FIGS. 9A through 9D show a further pump discharge valve 34. The discharge valve housing 34C may comprise one or more flow ports 34A that fluidly connect the interior of the housing 34C to the exterior thereof. A valve disk 64 may be rotatably mounted within the housing 34C and may comprise one or more valve ports 64A such that rotation of the valve disk 64 within the housing 34C causes the one or more valve ports 64A to be axially aligned with corresponding one(s) of the flow port(s) 34A. One or more magnets 60 may be affixed to the exterior surface of the drive shaft 40 and may rotate in an opening in the valve disk 64. The valve disk 64 may comprise one or more corresponding magnets 62 mounted such that rotation of the drive shaft 40 induces a magnetic field causing a corresponding magnetic torque force against the valve disk 64. A spring 66 may be disposed between the housing 34C and the valve disk 64 to rotationally urge the valve disk 64 to rotate to the position shown in FIG. 9C, wherein the valve ports 64A are out of axial alignment with the flow ports 34A in the housing 34C. Thus, the discharge valve 34 is closed. When the drive shaft 40 is rotated, magnetic torque urges the valve disk 64 against the spring 66, thereby rotating the valve disk 64 to the position shown in FIG. 9D. In such position, the valve ports 64A are aligned with the flow ports 34A and the valve 34 is open to flow. A possible advantage of the pump discharge valve 34 shown in FIGS. 9A through 9D is that flow is stopped in both directions. Using the valve shown in FIGS. 9A through 9D, it may be possible to implement the ESP (10 in FIG. 1) without a rotation lock, while still avoiding unintended electric voltage generation by reason of flow-induced pump rotation.

It will also be appreciated by those skilled in the art that a rotation actuated pump discharge valve as described above with reference to FIGS. 9A through 9D may have the benefit of limiting entry of settled solids into the pump as do the valves explained with reference to FIGS. 3A, 3B, 3C, 4A and 4B. In some ESPs, for example, those in which the motor is disposed longitudinally below the pump, a rotation actuated valve shown in and explained above with reference to FIGS. 9A through 9D may be used to control the pump intake. Accordingly, use of a rotation actuated valve is not limited to the pump discharge in accordance with the present disclosure.

In light of the principles described and illustrated herein, it will be recognized that the example embodiments can be modified in arrangement and detail without departing from such principles. The foregoing discussion has focused on specific examples, but other configurations are also contemplated. In particular, even though expressions such as in "an example," or the like are used herein, these phrases are meant to generally reference example possibilities, and are not intended to limit the disclosure to particular example configurations. As used herein, these terms may reference the same or different examples that are combinable into other examples. As a rule, any example referenced herein is freely combinable with any one or more of the other examples referenced herein, and any number of features of different examples are combinable with one another, unless indicated otherwise. Although only a few examples have been described in detail above, those skilled in the art will readily appreciate that many modifications are possible within the scope of the described examples. Accordingly, all such modifications are intended to be included within the scope of this disclosure as defined in the following claims.

The invention claimed is:

1. An electrical submersible pump (ESP) system, comprising:

a motor rotationally coupled to a pump;

a shaft rotationally coupled to the motor;

a lock disk rotatably coupled to the shaft and having at least one lock opening therethrough; and a rotation lock operable to stop transfer of rotation of the pump to the motor when the ESP is switched off, wherein the rotation lock comprises a solenoid actuated lock pin moveable between an unlocked position and a locked position, and wherein the lock pin is disposed in the at least one lock opening.

2. The system of claim 1, further comprising a pump discharge valve fluidly coupled to the pump.

3. The system of claim 2, wherein the pump discharge valve comprises at least one ball type check valve comprising a ball seat and a check ball engageable with the ball seat.

4. The system of claim 2 wherein the pump discharge valve comprises a shuttle valve.

5. The system of claim 1, further comprising a pump intake control valve fluidly coupled to the pump.

6. The system of claim 5, wherein the intake control valve comprises a ball type check valve comprising a ball seat and a check ball engageable with the ball seat, the ball type check valve operable to block backflow.

7. The system of claim 5, wherein the intake control valve comprises a flow bypass, the flow bypass operable to open at a predetermined pressure.

8. The system of claim 5, wherein the intake control valve comprises:

a first check valve comprising a first ball seat and a first check ball engageable with the first ball seat, the first check valve operable to block backflow; and a second check valve comprising a second ball seat and a second check ball engageable with the second ball seat, the second check valve operable to block backflow from an annular space between the ESP and a well tube.

9. The system of claim 1, wherein in the unlocked position, the lock pin is lifted out of the at least one lock opening.

10. The system of claim 1, wherein a solenoid is energized to move the lock pin into the unlocked position.

11. The system of claim 1, further comprising a pump discharge valve operable to stop backflow and forward flow through the pump when the ESP is switched off, wherein the pump discharge valve comprises:

at least one first magnet disposed on the shaft; and a valve disk movable between a first position and a second position and comprising an opening and at least one second magnet, wherein the shaft is disposed in the opening of the valve disk, wherein the at least one second magnet interacts with the at least one first magnet, and wherein rotation of the shaft rotates the at least one first magnet relative to the at least one second magnet, thereby applying a magnetic torque to the valve disk to move the valve disk from the first position to the second position.

12. An electrical submersible pump (ESP) system, comprising:

a motor rotationally coupled to a pump;

a drive shaft rotationally coupled to the motor; and a pump discharge valve operable to stop backflow and forward flow through the pump when the ESP is switched off, wherein the pump discharge valve comprises:

at least one first magnet disposed on the drive shaft; and a valve disk movable between a first position and a second position and comprising an opening and at least one second magnet, wherein the drive shaft is disposed in the opening of the valve disk, wherein the at least one second magnet interacts with the at least one first magnet, and wherein rotation of the drive shaft rotates the at least one first magnet relative to the at least one second magnet, thereby applying a magnetic torque to the valve disk to move the valve disk from the first position to the second position.

13. The system of claim 12, wherein:

the pump discharge valve comprises a housing with one or more flow ports;

the valve disk comprises one or more valve ports, wherein the one or more valve ports are aligned with the one or more flow ports when the valve disk is in the first position.

14. The system of claim 13, wherein the pump discharge valve further comprises a spring disposed between the housing and the valve disk, wherein the spring biases the valve disk toward the second position.

15. The system of claim 12, the system further comprising:

a lock disk rotatably coupled to the drive shaft and having at least one lock opening therethrough; and a rotation lock operable to stop transfer of rotation of the pump to the motor when the ESP is switched off, wherein the rotation lock comprises a solenoid actuated lock pin moveable between an unlocked position and a locked position, and wherein the lock pin is disposed in the at least one lock opening.

* * * * *